US008057054B2

(12) United States Patent
Hudis

(10) Patent No.: US 8,057,054 B2
(45) Date of Patent: Nov. 15, 2011

(54) LIGHT SYSTEM FOR A VENDING MACHINE

(75) Inventor: Scott B. Hudis, Stillwater, MN (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 164 days.

(21) Appl. No.: 12/229,875

(22) Filed: Aug. 27, 2008

(65) Prior Publication Data

US 2009/0059560 A1 Mar. 5, 2009

Related U.S. Application Data

(60) Provisional application No. 60/966,752, filed on Aug. 28, 2007.

(51) Int. Cl.
*F21V 33/00* (2006.01)

(52) U.S. Cl. ..... 362/92; 362/125; 362/234

(58) Field of Classification Search ..... 361/89, 361/92, 94, 125, 133, 154, 155, 234, 253; 362/92, 125, 126, 133, 154, 155, 234, 253
See application file for complete search history.

(56) References Cited

U.S. PATENT DOCUMENTS

| | | | | |
|---|---|---|---|---|
| 6,325,523 | B1 * | 12/2001 | Santosuosso et al. | 362/92 |
| 6,401,969 | B1 | 6/2002 | Yajima et al. | |
| 6,550,269 | B2 | 4/2003 | Rudick | |
| 6,726,341 | B2 | 4/2004 | Pashley et al. | |
| 2001/0013961 | A1 | 8/2001 | Klug et al. | |
| 2007/0133192 | A1 * | 6/2007 | Alessandro | 362/125 |
| 2008/0277361 | A1 * | 11/2008 | Primiano | 362/89 |
| 2009/0213579 | A1 * | 8/2009 | Saraiji et al. | 362/126 |

OTHER PUBLICATIONS

Notification of Transmittal of the International Search Report and the Written Opinion of the International Searching Authority, or the Declaration dated Dec. 9, 2008 in connection with PCT Application No. PCT/US08/74666.

Written Opinion of the International Searching Authority dated Dec. 9, 2008 in connection with PCT Application No. PCT/US08/74666.

* cited by examiner

*Primary Examiner* — Y My Quach Lee

(57) ABSTRACT

A lighting system for a vending machine is provided. The lighting system includes an LED light source extending along a first inner surface of the vending machine and a reflective surface extending along a second inner surface of the vending machine. The reflective surface is capable of reflecting light emitted by the light source in one direction in order to provide light to the interior of the vending machine from multiple directions.

20 Claims, 3 Drawing Sheets

LIGHT SYSTEM FOR A VENDING MACHINE

CROSS-REFERENCE TO RELATED APPLICATION(S) AND CLAIM OF PRIORITY

The present application is related to U.S. Provisional Patent Application No. 60/966,752, filed Aug. 28, 2007, entitled "LIGHTING SYSTEM FOR A VENDING MACHINE". Provisional Patent Application No. 60/966,752 is hereby incorporated by reference into the present application as if fully set forth herein. The present application hereby claims priority under 35 U.S.C. §119(e) to U.S. Provisional Patent Application No. 60/966,752.

TECHNICAL FIELD

This disclosure is generally directed to vending machines and, more specifically, to a lighting system for a vending machine.

BACKGROUND

The use of vending machines for providing various products, such as soft drinks or snacks, is well known. Typical vending machines provide lighting within the vending machine to illuminate the products that are available for purchase. Many of these machines employ fluorescent lighting for this purpose. Recently, some vending machines have used light emitting diodes (LEDs) instead of fluorescent or other conventional types of lighting in order to take advantage of the benefits of LEDs, which include reduced energy consumption, decreased heat production and increased lifetime. However, these vending machines have not been designed to maximize the effective lighting provided by the LEDs, resulting in vending machines that are not as efficient as possible.

SUMMARY

This disclosure is directed to a system for illuminating a product display area for a vending machine.

In a first embodiment, a vending machine includes a cabinet, or housing, having a product display area and a lighting system configured to provide light from multiple directions. The lighting system includes a light source and a reflective material. The light source extends along a first inner surface of the vending machine and is configured to emit a light towards the reflective material and towards a product display area located in an interior portion of the vending machine. The light source may include a plurality of light emitting diodes. The reflective material extends along a second inner surface of the vending machine and is adapted to reflect light emitted from the light source towards the product display area. The light emitted from the light source combines with the reflected light to illuminate the product display area.

In a second embodiment, a method includes emitting a light from a light source and reflecting the emitted light by a reflective surface. The light source extends along a first inner surface of a vending machine. The reflective material extends along a second inner surface of a vending machine. The light source may include a plurality of light emitting diodes. A product display area located in an interior portion of the vending machine is illuminated by combining light emitted from the light source with reflected light from the reflective surface.

In a third embodiment, a vending machine includes a cabinet, e.g. a housing structure, a door, a light source extending along a first inner surface of the door and a reflective material extending along a second inner surface of the door. The light source may include a plurality of light emitting diodes. The light source is configured to emit a light towards the reflective material and an interior portion of the vending machine cabinet. The reflective material is adapted to reflect light emitted from the light source towards the interior portion of the cabinet. The reflected light combines with the emitted light to illuminate the interior portion of the cabinet.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawing, in which.

DETAILED DESCRIPTION

Figure 1A:
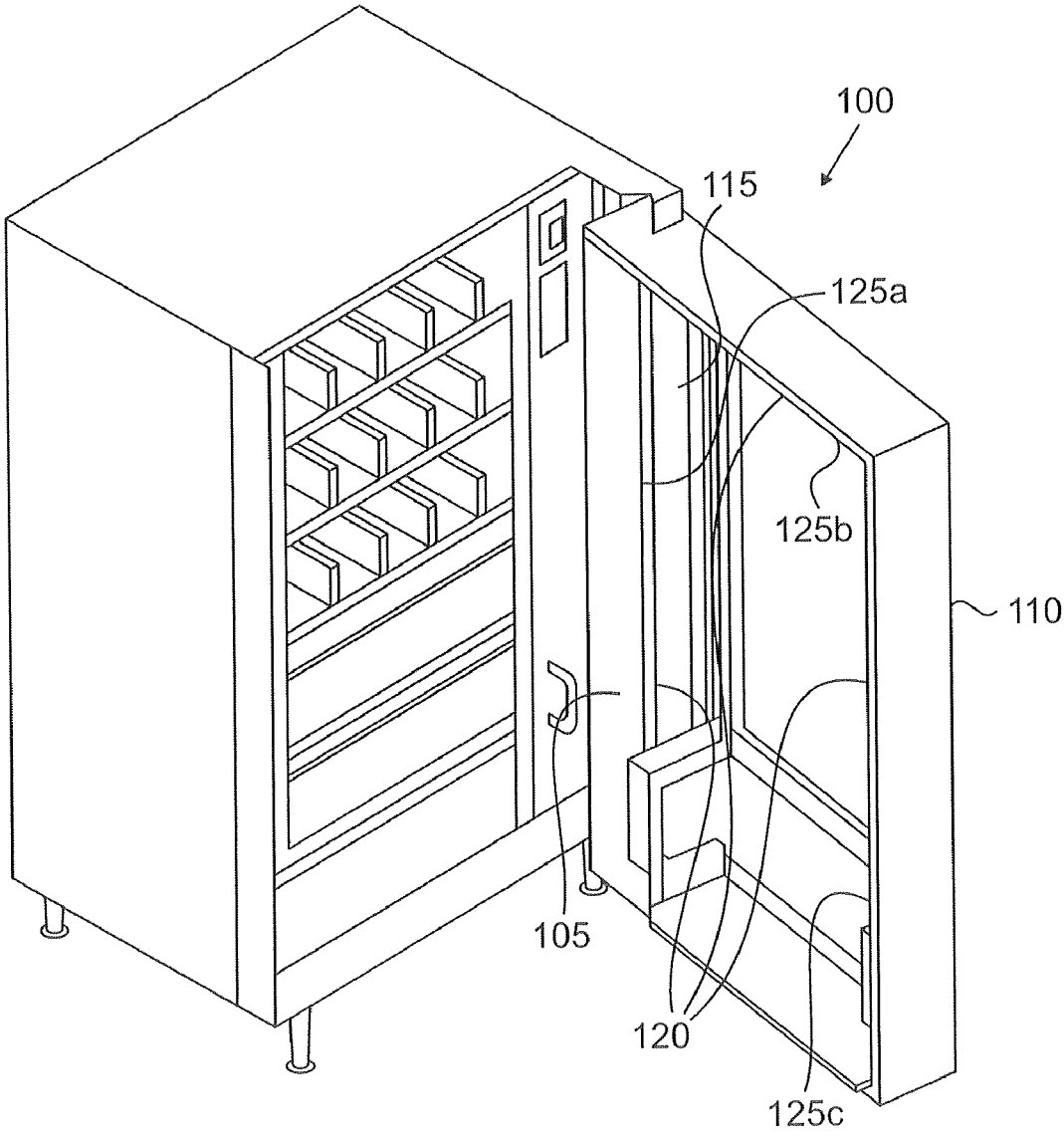
FIG. 1*a* illustrates a vending machine with a lighting system according to an embodiment of the present disclosure.

FIG. 1, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged vending machine.

FIG. 1 illustrates a vending machine 100 comprising a lighting system 105 according to an embodiment of the present disclosure. For the illustrated embodiment, the lighting system 105 is provided on a door 110 of the vending machine 100. However, it will be understood that the lighting system 105 may be otherwise located within the vending machine 100 without departing from the scope of the present disclosure. In some embodiments, the lighting system 105 is provided on the interior sides of a housing of the vending machine 100 housing (e.g. not on the door 110). In such embodiments, as the door 110 opens, the lighting system 105 remains fixed in relationship with the vending machine 100 and does not move with the door 110. In other embodiments, the vending machine includes a glass viewing panel separate from the door 110. In such embodiments, the lighting system 105 may be disposed on an interior portion of the housing of vending machine 100 in such location as to be adjacent to the glass viewing panel.

The lighting system 105 comprises a light source 115 and a reflective surface 120. For one embodiment, the light source 115 may comprise a plurality of light emitting diodes (LEDs). For a particular embodiment, the light source 115 may comprise a single 39-inch 4100 Kelvin degree light bar. The light source 115 is mounted vertically inside the door 110. For this embodiment, the light source 115 is mounted at an angle with respect to the surface of the door 110 in order to direct light onto products within the vending machine 100. For example, for one particular embodiment, the light source 115 may be mounted at an angle of about two and one half (2.5) degrees towards the interior of the vending machine 100. In such embodiment, the light is directed inward away from a door layer. The door layer is a planar area defined the back surface of the front facing portion of the door 110 (e.g. the back of the glass portion of the door 110). In other embodiments, the light source 115 may be mounted within a range of zero (0) degrees to five (5) degrees.

Figure 1B:
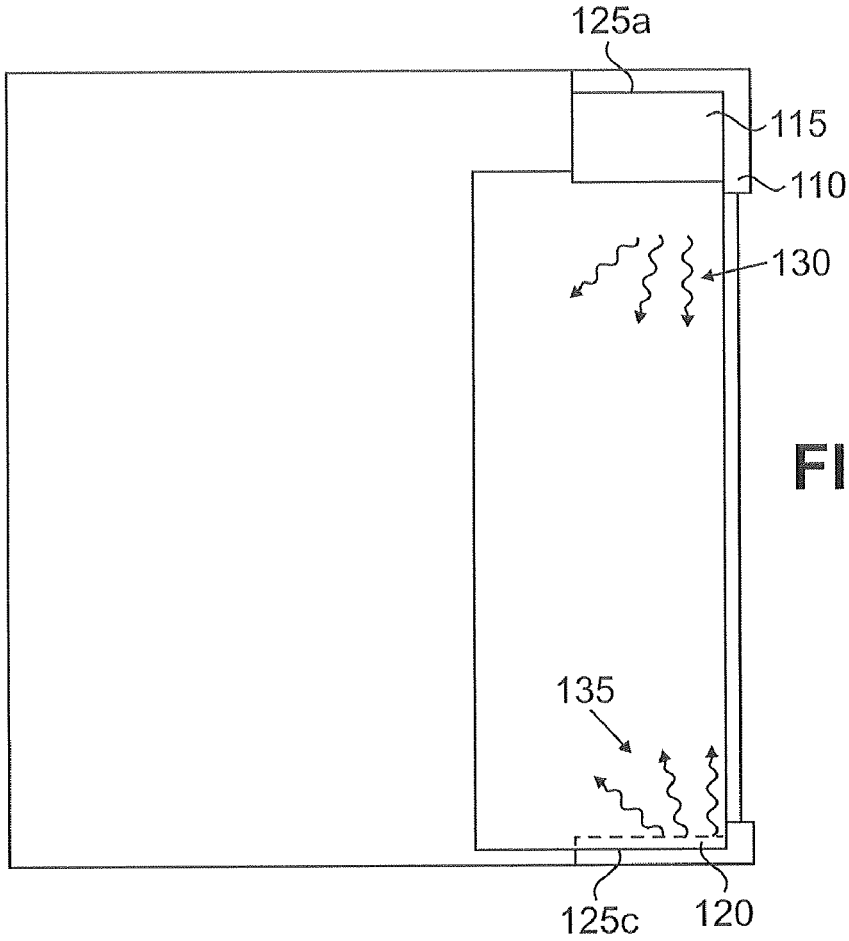
FIG. 1*b* illustrates a simple block diagram of a top view of a vending machine with a lighting system and light beam trajectory according to an embodiment of the present disclosure.
Figure 1C:
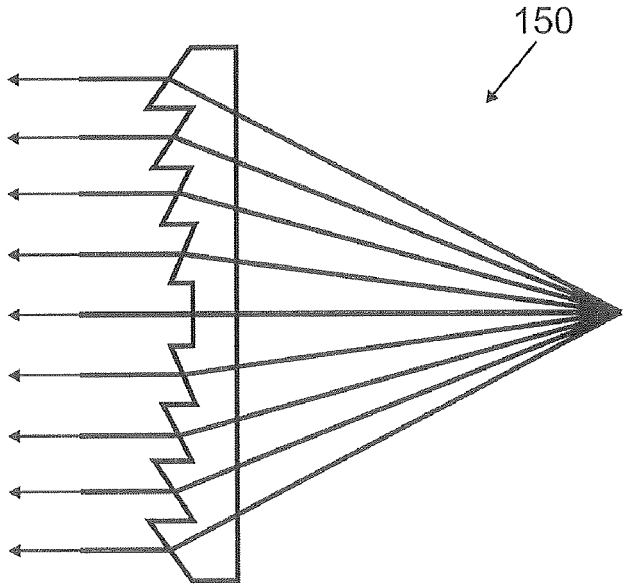
FIG. 1*c* illustrates an exemplary lens according to an embodiment of the present disclosure.

In one embodiment, the light source 115 includes a lens 150, illustrated in FIG. 1*c*, such as, but not limited to, a Fresnel lens, a compound lens or series of lenses, to assist in directing light towards the reflective surface 120. In such embodiments, the lens 150 is configured so as to transition a diverging light beam to be a collimated light beam. The collimated light beam is directed along a path towards the reflective surface 120. As such, the light traverses a path along a beam layer towards the reflective surface 120. The beam layer is defined by a straight line between the light source and a longitudinal centerline (e.g. a vertical line for a vertical facing reflective surface 120 and a horizontal line for a horizontal facing reflective surface 120).

Figure 1D:
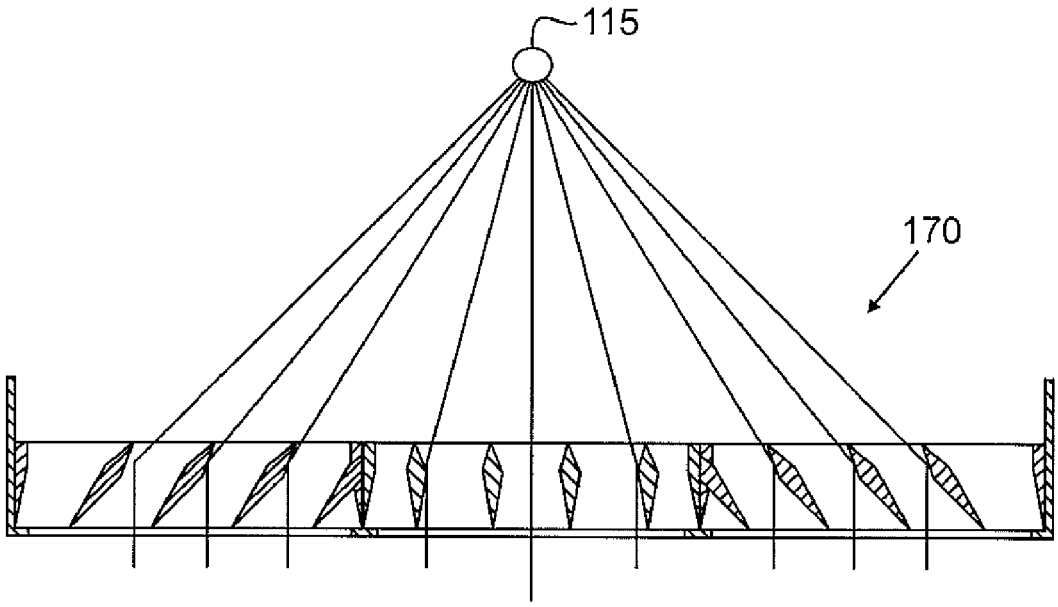
FIG. 1*d* illustrates exemplary reflective louvers according to an embodiment of the present disclosure.

In another embodiment, the light source 115 includes a series of reflective louvers 170, illustrated in FIG. 1*d*, to assist in directing light towards the reflective surface 120. In such embodiments, the reflective louvers 170 are configured so as to transition a diverging light beam to be a collimated light beam. The collimated light beam is directed along a path towards the reflective surface 120. As such, the light traverses a path along the beam layer towards the reflective surface 120.

The reflective surface 120 comprises a white, vacuum-formed liner situated along one or more inner surfaces 125*a-c* of the door 110. The inner surfaces 125*a-c* are disposed along the interior portion of the door frame. However, it will be understood that the reflective surface 120 may comprise any suitable reflective material and may be situated in any suitable location on the vending machine 100. The reflective surface 120 is operable to reflect the light emitted by the light source 115. In this way, light provided by the light source 115 in one direction is reflected to illuminate the interior of the vending machine 100 from multiple directions, thereby maximizing the effective lighting provided by the light source 115 and improving the visibility of products inside the vending machine 100.

In the embodiment illustrated in FIG. 1*b*, the reflective surface 120 is operable to reflect light within a range extending from zero (0) degrees (e.g. back towards the light source 115) to ninety (90) degrees (e.g. towards the interior of the vending machine 100). It would be understood that illustration of the light source 115 as comprising a flat emitting surface merely is exemplary and that such emitting surface may be curved, angled or coupled to a lens, as discussed herein above with respect to FIG. 1*a*. As such, the light 130 emitted by light source 115 is reflected 135 by reflective surface 120 towards light source 115 and the interior of the vending machine 100. In other embodiments, the inner surfaces 125*a-c* of the door 110 are situated at an angle of about two and one half (2.5) degrees towards the interior of the vending machine 100. In additional embodiments, the inner surfaces 125*a-c* of the door 110 may be situated to face towards the interior of the vending machine within a range of zero (0) degrees to five (5) degrees.

Figure 2:
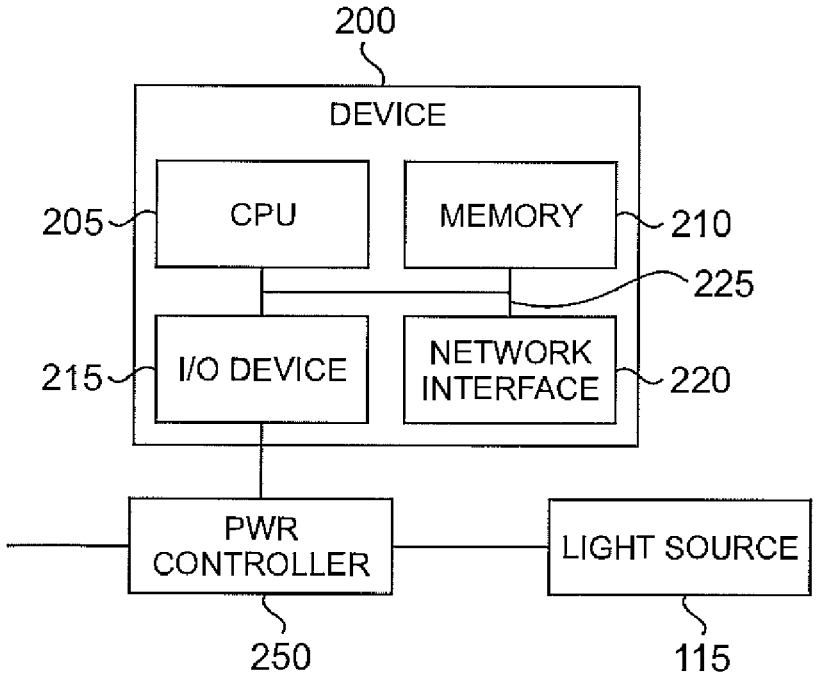
FIG. 2 illustrates a block diagram of a controller according to an embodiment of the present disclosure.

Referring now to FIG. 2, a somewhat simplified illustration of a lighting controller device 200 according to one embodiment of the present disclosure is depicted. One embodiment of the controller 200 that may be used to operate the light source 115 is illustrated. The controller 200 may be a computer, or any other device capable of transmitting, processing, and/or receiving signals via wireless and/or wireline communication links. The controller 200 includes a central processing unit ("CPU") 205, a memory unit 210 (e.g. a computer readable medium), an input/output ("I/O") device 215, and a network interface 220. The network interface may be, for example, one or more network interface cards (NICs) that are each associated with a media access control (MAC) address. The components 205, 210, 215, and 220 are interconnected by one or more communication links 225 (e.g., a bus). It is understood that the controller 200 may be differently configured and that each of the listed components may actually represent several different components. For example, the CPU 205 may actually represent a multi-processor or a distributed processing system; the memory unit 210 may include different levels of cache memory, main memory, hard disks, and remote storage locations; and the I/O device 215 may include monitors, keyboards, and the like. Alternatively, one or more components may be implemented in a single component such as a microcontroller. The network interface 220 enables the controller 200 to connect to a network (not illustrated).

The controller 200 electrically couples to a power control 250. The power control 250 is coupled between the light source 115 and a power source (not illustrated). The power control 250 is adapted to sever an electrical path between the power source and the light source 115, (e.g. the power control is adapted to turn-off the light source 115) in response to commands, or electrical signals, received from the controller 200.

The lighting system 105 is electrically coupled to the controller 200. The controller 200 comprises software and a plurality of programming instructions stored in memory 210 to operate the light source 115. In one embodiment, the controller 200 is operable to turn-off the light source 115 based on a time of day. In another embodiment, the controller 200 is configured to turn-off the light source 115 based on a day of the week. In yet another embodiment, the controller 200 is operable to turn-off the light source 115 based upon an occurrence of a period of inactivity. For example, if no purchases have occurred from the vending machine 100 within a preceding half hour period, the controller 200 may turn off the light source 115 to conserve energy consumption.

In some embodiments, the controller 200 is configured to adjust a level of illumination created by the light emitted from the light source 115. In one embodiment, the controller 200 turns-off a portion of the light source 115. For example, the light source 115 may be a plurality of LEDs. The controller 200 turns-off only a portion of the plurality of LEDs such that every other LED is turned-off. It would be understood that turning-off every other LED is exemplary and that the controller 200 is configured to turn-off varying increments of LEDs such as, but not limited to, one LED for every three, two LEDs for every three, or other combinations. In another embodiment, the lighting system 105 comprises two or more light sources 115. In such embodiment, the controller 200 is configured to turn-off one of the light sources 115 to adjust the level of illumination. In yet another embodiment, the controller 200 is configured to use pulse width modulation to adjust the level of illumination. The controller 200 is configured to reduce an amount of power supplied to the light source 115 via the power controller 250. The controller 200, via the power controller 250, modulates a duty cycle of the power source to control the amount of power sent to the light source 115. As such, the level of illumination created by the light emitted from the light source 115 adjusts in relation to an adjustment of the amount of power sent to the light source 115.

It may be advantageous to set forth definitions of certain words and phrases used throughout this patent document. The term "packet" refers to any information-bearing communication signal, regardless of the format used for a particular communication signal. The terms "application," "program," and "routine" refer to one or more computer programs, sets of instructions, procedures, functions, objects, classes, instances, or related data adapted for implementation in a suitable computer language. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A system for providing lighting for a vending machine, the system comprising:

a light source configured in and extending along a first inner surface of a door of the vending machine, the light source configured to direct a first portion of light along a planar surface of the door towards a first reflective material and a second portion of light towards an interior of the vending machine; and the first reflective material extending along a second inner surface of the vending machine, the first reflective material configured to reflect the first portion of light emitted from the light source towards the interior of the vending machine such that the interior of the vending machine is illuminated from at least two directions.

2. The system of claim 1, wherein the light source further comprises a lens operable to collimate the first portion of light towards the first reflective material.

3. The system of claim 1, wherein said light source is disposed at an angle between two and three degrees from a layer created between said first inner surface and said second inner surface.

4. The system of claim 1, further comprising:

a second reflective material extending along a third inner surface of the vending machine, the second reflective material operable to reflect a third portion light emitted from the light source towards the interior of said vending machine.

5. The system of claim 1, wherein said light source is a plurality of light emitting diodes (LEDs).

6. The system of claim 5, further comprising:

a controller for regulating operation of said lighting source.

7. The system of claim 6, wherein said controller further comprises:

a first processor;

a computer readable medium electronically coupled to said first processor; and a plurality of instructions wherein a least a portion of said plurality of instructions are storable in said computer readable medium, and further wherein said plurality of instructions are configured to cause said processor to perform the steps of:

determining the occurrence of at least one of a specified time of day, a specified day of the week and a predefined period of inactivity; and dimming said light source in response to the determining of the occurrence of at least one of the time of day, the day of the week and the predefined period of inactivity.

8. The system of claim 7, wherein dimming said light source comprises at least one of turning off at least one of said plurality of LEDs and adjusting a power supplied to said light source.

9. A method for providing lighting for a vending machine, the method comprising:

emitting a light from the light source extending along a first inner surface of a door of the vending machine, the light source configured to direct a first portion of light along a planar surface of the door of the vending machine towards a first reflective material and a second portion of light towards an interior of the vending machine;

reflecting the first portion of light towards an interior of the vending machine by the first reflective material extending along a second inner surface of the door of the vending machine, wherein the reflected light combines with the emitted light to illuminate an interior of the vending machine from at least two directions;

determining the occurrence of at least one of a specified time of day, a specified day of the week and a predefined period of inactivity; and dimming the light source in response to the determining of the occurrence of at least one of the time of day, the day of the week and the predefined period of inactivity.

10. The method of claim 9, the method further comprising:

refracting the light, with a lens; and collimating the light towards the reflective material.

11. The method of claim 9, the method further comprising:

collimating the light along a trajectory at an angle between two and three degrees from a layer created between the first inner surface and the second inner surface.

12. The method of claim 9, further comprising:

reflecting the light towards an interior of the vending machine by a second reflective material extending along a third inner surface of the door of the vending machine.

13. The method of claim 9, wherein the light source is a plurality of light emitting diodes (LEDs).

14. The method of claim 13, further comprising:

regulating an operation of the lighting source by a controller.

15. The method of claim 9, wherein dimming the light source comprises at least one of turning off at least one of the plurality of LEDs and adjusting a power supplied to the light source.

16. A vending machine comprising:

a housing structure;

a door pivotally coupled to the housing structure;

a light source configured in and extending along a first inner surface of the door, the light source configured to direct a first portion of light along a planar surface of the door towards a first reflective material and a second portion of light towards an interior of the housing structure; and a reflective material extending along a second inner surface of the door, wherein the reflective material is configured to reflect the first portion of light towards the interior of the housing structure such that the second portion of light and the first portion of light reflected from the reflective material combine to illuminate the interior of the housing from at least two directions.

17. The vending machine of claim 16, wherein said light source is a number of light emitting diodes.

18. The vending machine of claim 17 further comprising a controller adapted to regulate operation of said lighting source.

19. The vending machine of claim 18, wherein said controller further comprises:

a first processor;

a computer readable medium electronically coupled to said first processor; and a plurality of instructions wherein a least a portion of said plurality of instructions are storable in said computer readable medium, and further wherein said plurality of instructions are configured to cause said processor to perform the steps of;

deteimining the occurrence of at least one of a specified time of day, a specified day of the week and a predefined period of inactivity;

dimming said light source in response to the determining of the occurrence of at least one of the time of day, the day of the week and the predefined period of inactivity.

20. The apparatus of claim 19, turning-off said light source comprises at least one of turning off at least one of said plurality of LEDs and adjusting a power supplied to said light source.

* * * * *